United States Patent [19]

Asbury

[11] Patent Number: 4,619,003

[45] Date of Patent: Oct. 28, 1986

[54] INSULATED HELMET

[75] Inventor: Robert L. Asbury, Mill Valley, Calif.

[73] Assignee: Bell Helmets Inc., Norwalk, Calif.

[21] Appl. No.: 801,329

[22] Filed: Nov. 25, 1985

[51] Int. Cl.[4] ..... A42B 1/06; A42B 3/00

[52] U.S. Cl. ..... 2/5; 2/412

[58] Field of Search ..... 2/5, 6, 7, 410, 412, 2/425

[56] References Cited

U.S. PATENT DOCUMENTS

| | | | |
|---|---|---|---|
| 935,556 | 9/1909 | Smith . | |
| 1,347,046 | 7/1920 | McDonough . | |
| 1,722,869 | 7/1929 | Janusek | 2/5 |
| 2,381,524 | 8/1945 | Taylor | 2/7 |
| 2,709,667 | 5/1955 | Grubb et al. | 2/5 |
| 2,769,176 | 11/1956 | Gransay et al. . | |
| 2,846,683 | 8/1958 | Dye et al. . | |
| 2,991,478 | 7/1961 | Zbikowski . | |
| 3,082,428 | 3/1963 | Zbikowski . | |
| 3,310,811 | 3/1967 | Iacono, Jr. . | |
| 3,344,433 | 10/1967 | Stapenhill . | |
| 3,496,854 | 2/1970 | Feldmann et al. . | |
| 3,783,450 | 1/1974 | O'Connor . | |
| 3,873,997 | 4/1975 | Gooding . | |
| 3,925,821 | 12/1975 | Lewicki . | |
| 4,044,400 | 8/1977 | Lewicki et al. . | |
| 4,307,471 | 12/1981 | Lovell | 2/411 |
| 4,397,045 | 8/1983 | Schonwetter et al. | 2/7 |

FOREIGN PATENT DOCUMENTS

| | | | |
|---|---|---|---|
| 397985 | 9/1933 | United Kingdom | 2/412 |

*Primary Examiner*—Henry S. Jaudon

*Attorney, Agent, or Firm*—William W. Haefliger

[57] ABSTRACT

A heat resistant helmet composite comprises:

(a) an outer dome-shaped shell, (b) an inner liner received in the shell, the liner having an outer dome shaped surface to fit in the shell, and (c) a metal foil sheet extending between the shell and the liner and extending over and adjacent the dome-shaped surface of the liner.

Typically, the foil sheet is gathered throughout its major extent, to provide multiple locally overlapping layers of foil that increase the heat transfer resistance between the shell and liner.

10 Claims, 6 Drawing Figures

INSULATED HELMET

BACKGROUND OF THE INVENTION

This invention relates generally to heat resistant helmets, and more particularly concerns a composite or multiple interfitting section helmet incorporating heat reflective metallic structure within the composite.

There is a need for improvements in heat resistance of helmets, and particularly in fire helmets, in order to prevent injury to wearers, as for example fire fighters, and also to preserve or extend the useful lives of such protective helmets. In particular, there is a need for improving the construction of composite helmets in a simple inexpensive way, to meet the above need.

SUMMARY OF THE INVENTION

It a major object of the invention to provide the above described needed improvements. Basically, in accordance with the invention, a heat resistant, helmet composite is provided, which includes:

(a) an outer dome-shaped shell, (b) an inner liner received in the shell, the liner having an outer dome-shaped surface to fit in the shell, and (c) a metal foil sheet extending between the shell and the liner and extending over and adjacent the dome-shaped surface of the liner.

As will appear, the foil sheet is typically gathered throughout its major extent, to provide multiple locally overlappying layers of foil that increase the heat transfer resistance between the shell and liner. In this regard, the liner typically consists of foamed plastic material, and is substantially thicker than the shell, the foil sheet loosely adherent to said liner outer surface; and the outer shell typically consists of hard plastic material, and has an inner surface contacted by the foil sheet. Multiple heat resistant effects and temperature equalizations are thereby produced, as will appear.

Further, the gathered foil sheet has an edge portion adjacent a looping edge defined by the inner liner; and an inner dome-shaped shell may be received in the liner, said inner shell having a rim portion confining said foil sheet edge portion proximate the looping edge defined by the inner liner. In addition, the outer shell typically defines a looping slot; and said inner shell rim portion includes a looping flange received in said slot.

These and other objects and advantages of the invention, as well as the details of an illustrative embodiment, will be more fully understood from the following specification and drawings in which:

DRAWING DESCRIPTION

Figure 1:
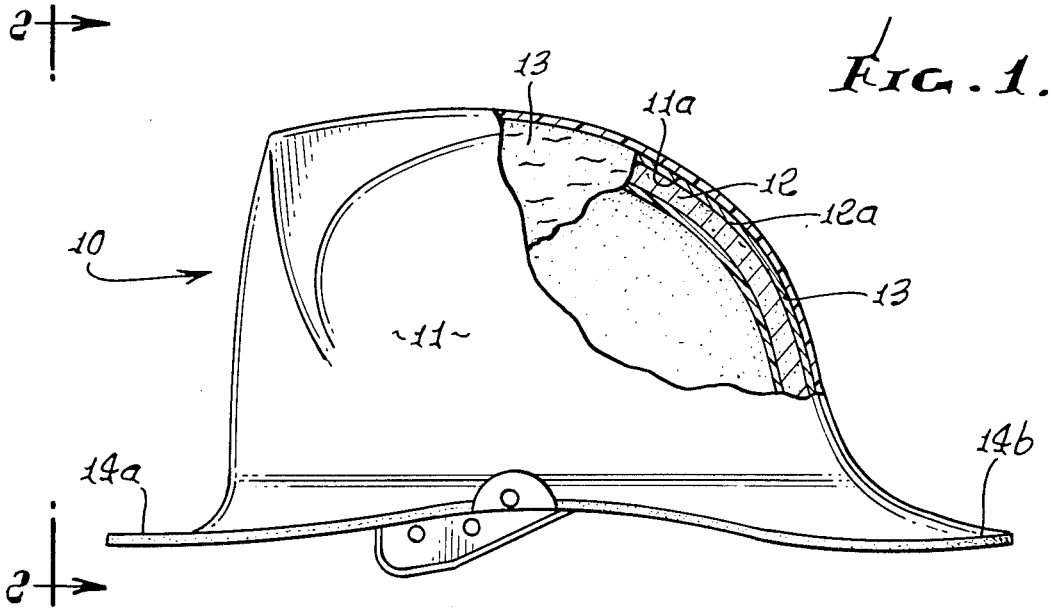
FIG. 1 is a side elevation of a helmet incorporating the invention.
Figure 2A:
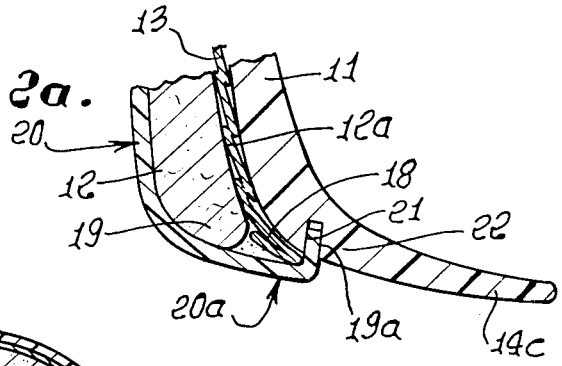
FIG. 2 is a frontal view on lines 2—2 of FIG. 1, partly broken away to show interior structure.
Figure 2:
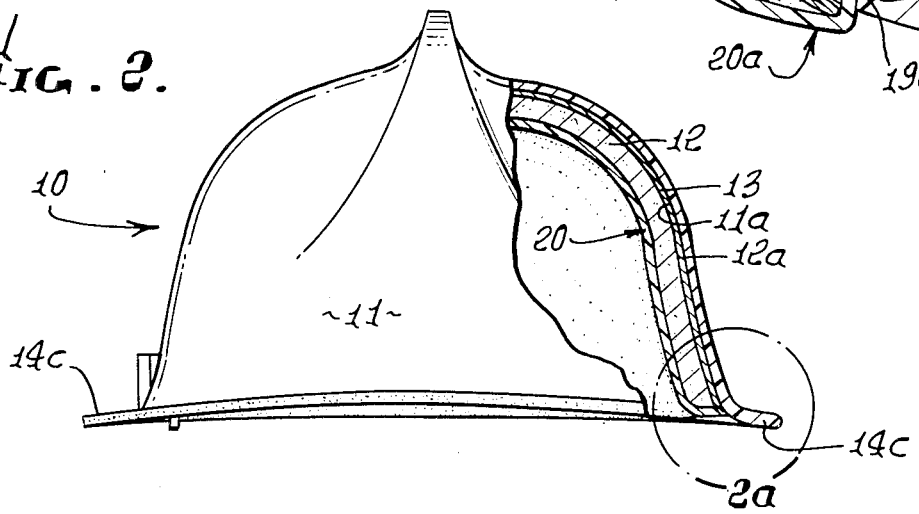
Figure 5:
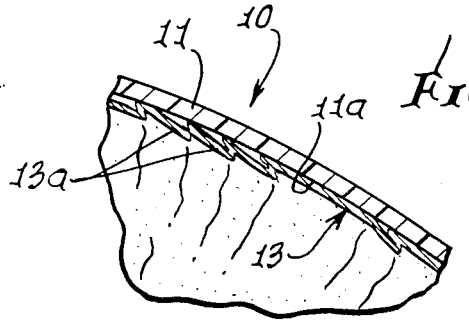
Figure 3:
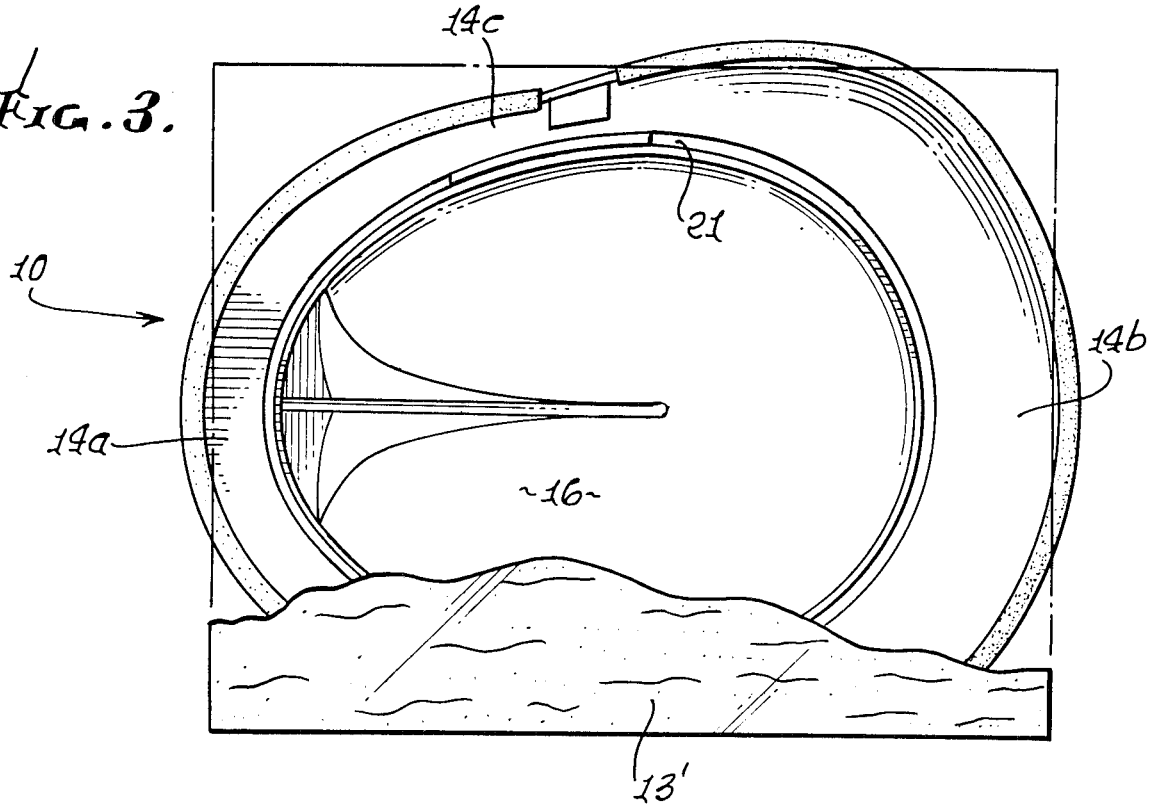
Figure 4:
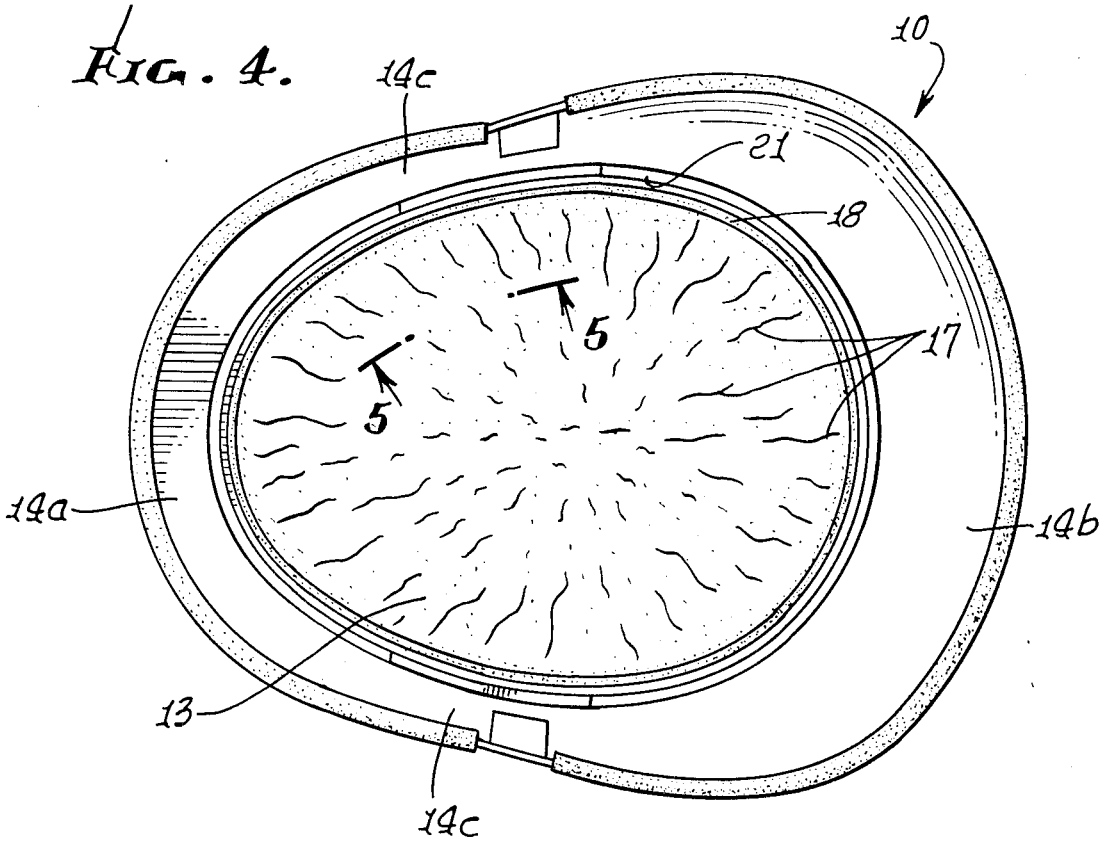

FIG. 2*a* is a fragmentary elevational view of a lower side portion of the helmet, and taken on lines 2*a*—2*a* of FIG. 2;

FIG. 3 is a bottom plan view of the helmet shell, showing a stage in helmet composite assembly;

FIG. 4 is a view like FIG. 3, but showing a later stage in helmet composite assembly; and FIG. 5 is a fragmentary elevational view in section of the structure of a dome interior portion of the FIG. 1 helmet.

DETAILED DESCRIPTION

Referring to FIGS. 1, 2, 2*a* and 5, the heat resistant helmet 10 comprises an outer dome-shaped shell 11; an inner liner 12 received into the shell, the liner being dome-shaped to closely fit in the shell; and a metal (as for example aluminum) foil sheet 13 extending between the shell and the liner. The liner has an outer, or outward facing dome-shaped surface 12*a* that corresponds in dome-shape to the inner surface 11*a* of the shell, and the foil sheet extends over and fits on the surface 12*a*. The liner advantageously consists of shock absorbing foamed plastic material such as expanded polystyrene, and is between 3 and 8 times thicker than the shell, and the shell advantageously consists of impact resistant hard plastic material, as for example high temperature resistant polycarbonate. Foil sheet 13 is loosely adherent to the surface 12*a*, and is gathered in random folds, or multiple overlays, as indicated at 13*a* in FIG. 5.

The air space between surfaces 12*a* and 11*a* is somewhat greater than the foil thickness, to receive the foil, and folds 13*a*, extend closely adjacent surfaces 12*a* and 13*a*. The air space referred to serves as insulation, i.e. a barrier to heat transfer from shell 11 to liner 12; and the foil greatly increases the insulative or heat transfer resistive effect, as will appear.

In this regard, the outer liner may be shaped to have fore and aft brims as at 14*a* and 14*b*, with narrow side brims 14*c* connecting them, whereby the helmet has the shape of a fire helmet, and has unusually advantageous use as such.

As referred to, the foil acts to substantially lower the temperature inside the helmet, due to two effects. First, it acts to reflect radiant heat outwardly, i.e. back toward the shell; and second it rapidly transfers heat, by conduction from locally heated areas, around the liner, tending to equalize the temperature of the foil. Such local heating of the foil may result from external local heating of the outer shell, as by a fire source at one side only of the shell, for example. Therefore, the temperature of the liner is kept more equalized at different zones thereof. Further, the heat transferred by conduction to the entire foil is thereby enabled to radiate (i.e. dissipate) back outwardly from the entirety of the foil. Finally, the gathering of the foil in overlapping folds enhances the above effects and traps air between the folds, which acts as insulation against heat transfer toward and into the liner. The liner itself, consisting of foam, also acts as a thermal insulation barrier to heat transfer inwardly toward the wearer's head.

FIG. 3 shows the manner of creating the foil folds 13*a* referred to above. Prior to insertion of the liner into the shell, a flat foil sheet 13' is laid over the open underside of the shell. Thereafter, the domed liner 12 is carefully pressed downwardly against the foil sheet and into the recessed interior 16 of the shell, carrying the foil sheet with it and gradually producing the folds, as also indicated at 17 in FIG. 4. In that view, the liner is not shown, to enable viewing of the gathered foil. The latter also has an edge portion 18 adjacent a looping edge or rim 19 defined by the liner. See also FIG. 2*a*.

A further feature of the invention is the provision for protective improvement of the foil edge portion 18 and the liner looping edge 19. An inner dome shaped shell 20 is provided for this purpose, that shell being received into the liner and conforming to the inner surface domed curvature thereof. See FIGS. 1 and 2. Shell 20 may also consist of molded plastic such as styrene.

The stiff inner shell 20 has a rim portion 20*a* confining the foil sheet edge portion 18, and the liner looping edge 19, as for example is shown in detail in FIG. 2*a*. Complete confinement, as well as attachment of the inner shell to the outer shell is provided by means of a looping slot 21 formed in the thickened wall 22 of the outer shell, and by interference reception in that slot of a looping flange 19*a* integral with rim portion 19. Slot 21 and flange 19*a* may both extend in a loop around the helmet at brim level, whereby the foil edge portion 18 is completely protectively confined.

I claim:

1. In a heat resistant helmet composite, the combination comprising (a) an outer dome-shaped shell, (b) an inner liner received in the shell, the liner having an outer dome shaped surface to fit in the shell, and (c) a metal foil sheet extending between the shell and the liner and extending over and adjacent the dome-shaped surface of the liner, (d) the liner consisting of foamed plastic material, and being substantially thicker than the shell, the foil sheet loosely adherent to said liner outer surface.

2. The combination of claim 1 wherein said foamed plastic material consists of expanded polystyrene.

3. The combination of claim 1 wherein said shell consists of hard plastic material, and has an inner surface contacted by the foil sheet.

4. The combination of claim 3 wherein the shell plastic material consists of high temperature polycarbonate.

5. The combination of claim 1 wherein said outer liner has fore and aft brims, whereby the helmet has the shape of a fire helmet.

6. In a heat resistant helmet composite, the combination comprising (a) an outer dome-shaped shell, (b) an inner liner received in the shell, the liner having an outer dome shaped surface to fit in the shell, and (c) a metal foil sheet extending between the shell and the liner and extending over and adjacent the dome-shaped surface of the liner, (d) the foil sheet being gathered throughout its major extent, to provide multiple locally overlapping layers of foil that increase the heat transfer resistance between the shell and liner.

7. The combination of claim 6 wherein the gathered foil sheet has an edge portion adjacent a looping edge defined by the inner liner.

8. The combination of claim 7 including an inner dome-shaped shell received in the liner, said inner shell having a rim portion confining said foil sheet edge portion proximate the looping edge defined by the inner liner.

9. The combination of claim 8 wherein said outer shell defines a looping slot and said inner shell rim protion includes a looping flange receive in said slot.

10. The combination of claim 8 wherein said inner liner consists of stiff molded plastic material.

* * * * *